US010378747B1

(12) United States Patent
Hanslip

(10) Patent No.: US 10,378,747 B1
(45) Date of Patent: Aug. 13, 2019

(54) FIELD-CONFIGURABLE LED TAPE LIGHT

(71) Applicant: Ryan Hanslip, San Francisco, CA (US)

(72) Inventor: Ryan Hanslip, San Francisco, CA (US)

( * ) Notice: Subject to any disclaimer, the term of this patent is extended or adjusted under 35 U.S.C. 154(b) by 0 days.

(21) Appl. No.: 16/159,404

(22) Filed: Oct. 12, 2018

Related U.S. Application Data

(63) Continuation-in-part of application No. 15/716,244, filed on Sep. 26, 2017, now Pat. No. 10,111,294.

(60) Provisional application No. 62/697,645, filed on Jul. 13, 2018, provisional application No. 62/572,138, filed on Oct. 13, 2017, provisional application No. 62/524,380, filed on Jun. 23, 2017, provisional application No. 62/483,883, filed on Apr. 10, 2017, provisional application No. 62/400,016, filed on Sep. 26, 2016.

(51) Int. Cl.

| | |
|---|---|
| ***H05B 33/00*** | (2006.01) |
| ***F21V 23/06*** | (2006.01) |
| ***F21S 4/24*** | (2016.01) |
| ***F21V 23/00*** | (2015.01) |
| ***H05B 33/08*** | (2006.01) |
| *F21Y 115/10* | (2016.01) |
| *F21Y 103/10* | (2016.01) |

(52) U.S. Cl.
CPC ..... *F21V 23/06* (2013.01); *F21S 4/24* (2016.01); *F21V 23/003* (2013.01); *H05B 33/0857* (2013.01); *F21Y 2103/10* (2016.08); *F21Y 2115/10* (2016.08)

(58) Field of Classification Search
CPC ..... H05K 1/189; H05K 1/14; H05K 1/0283; H05K 2201/0133; H05K 2201/09045; H05K 2203/0271; H05K 3/20; H05K 3/22; H05K 2201/10106; H05K 1/0278; H05K 1/05; H05K 1/092; H05K 2203/0143; H05K 2203/1311; H05K 2203/1469; H05K 2203/167; H05K 3/007; H05K 3/1216; H05K 3/281; H05K 3/284; H05B 2203/021; H05B 1/0244; H05B 1/0288; H05B 2203/018; H05B 3/145; H05B 2203/014; H05B 3/46
See application file for complete search history.

(56) References Cited

U.S. PATENT DOCUMENTS 8,618,573 B2 * 12/2013 Sugiura ..... H01L 33/642 257/730
2013/0208495 A1 * 8/2013 Dau ..... F21V 7/0008 362/551

* cited by examiner

*Primary Examiner* — Monica C King
(74) *Attorney, Agent, or Firm* — Critical Path IP Law, LLC

(57) ABSTRACT

LED tape is provided that employs a plurality of surface-mounted contact terminals. The LED tape can be severed at discrete locations adjacent to the contact terminal to create a tape segment configured to interconnect to a power source or to another tape segment by way of a wire selectively received and secured within corresponding terminal connectors. The use of the connecting wire omits the need for a mechanical connector or integration by soldering currently required to interconnect LED tape segments.

17 Claims, 10 Drawing Sheets

FIELD-CONFIGURABLE LED TAPE LIGHT

This application claims the benefit of U.S. Provisional Patent Application Ser. No. 62/572,138, filed Oct. 13, 2017, the entire disclosure of which is incorporated by reference herein.

This application also claims the benefit of U.S. Provisional Patent Application Ser. No. 62/697,645, Jul. 13, 2018, the entire disclosure of which is incorporated by reference herein.

This application is a continuation-in-part of U.S. patent application Ser. No. 15/716,244, filed Sep. 26, 2017, now U.S. Pat. No. 10,111,294, issued Oct. 23, 2018, which claims the benefit of U.S. Provisional Patent Application Ser. No. 62/400,016, filed Sep. 26, 2016, U.S. Provisional Patent Application Ser. No. 62/483,883, filed Apr. 10, 2017, and U.S. Provisional Patent Application Ser. No. 62/524,380, filed Jun. 23, 2017, the entireties of which are incorporated by reference herein.

FIELD OF THE INVENTION

Embodiments of the present invention are generally related to LED lighting strips or tape, and more particularly to a method of interconnecting discrete LED lighting strip or tape segments, wherein at least one segment in a series thereof has been cut or otherwise modified to decrease its length.

BACKGROUND OF THE INVENTION

Continuous linear lighting are used to highlight architectural elements while providing primary and accent lighting. Such fixtures are often used to illuminate coves, pathways, walkways, shelving, countertops, etc. Linear lighting systems previously employed incandescent and festoon type light bulbs selectively arranged within a mounting track. One of ordinary skill in the art will appreciate the bulbs associated with traditional systems present many drawbacks such as 1) excessive heat, 2) high lamp replacement cost, 3) regular service labor costs, 4) increased size, and/or 5) minimal features and options. In an attempt to address these issues, designers and architects initially turned to "rope lights" comprised of interconnected LED lighting elements. Although rope lights have a lifespan greater than their predecessors, they still have drawbacks—dimming difficulties, lack of color rendering consistency, and poor light diffusion. Although the market has increasingly demanded improved performance from the latest LED-related technology to adequately replace the old incandescent and fluorescent lights, rope lights have not become a professional standard for linear lighting applications.

Lighting manufacturers have sought to address the drawbacks associated with the prior art by providing "tape lights" (also referred to herein as "LED tape"), that are similar to rope lights but employ brighter and more efficient LED lighting elements and other associated components and drivers. Tape lights are usually comprised of a substrate having a first surface that accommodates one or more LED lighting elements and a second surface at least partially comprised of an adhesive. Conductors used to interconnect adjacent LED lighting elements are integrated within the substrate thickness. Tape lights were welcomed by the industry because they present a compact form-factor and high-output lighting. Unfortunately, as those of ordinary skill in the art will appreciate, architects and builders sometimes avoid tape lights as light "tape" is often not viewed as a proper light "fixture." LED tape is also sometimes avoided because it is difficult and time consuming to interconnect lengths of tape to create an elongate tape element.

Tape lights are desirable as the length of a tape light strip can be selectively decreased by cutting the substrate between LED lighting elements. Some tape light systems employ cut points along their length that are marked with a cutline indicator because severing the tape light in locations other than predefined cut points would adversely affect the functionality of the system. The cut points often are associated with positive and negative contact terminals that later accept connectors used to fix the severed end to a power supply or to another tape segment. Hand soldering, a meticulous and time-consuming process, is normally the preferred method to interconnect the cut end of a light tape strip to a power source, for example.

Alternatively, a mechanical connector may be used that employs positive and negative conductors. Mechanical connectors rely on pressure to maintain contact between the positive and negative conductors with corresponding contact terminals at the severed end of the tape and often fail because the connected components (i.e., leads/conductors) are very small. Further, users often cut the LED tape strip incorrectly and, thus, do not provide sufficient conductor surface area at the contact terminal to receive and secure the mechanical connector. If the tape light is cut, for example, a millimeter to the left or right of the cutline, the small contact terminals would either be misaligned or engage the incorrect terminal of the mechanical connector, which could cause melting, fire, or create a shock hazard. Further, the mechanical connection provided by pressure connectors is tenuous, and easily broken with a slight tug. The prior art method of connecting tape lights severed at a cut line is shown and described in U.S. Pat. No. 8,262,250 to Li et al, which is incorporated by reference herein.

That is, the lights used in LED tape are also often important. That is, many have attempted to create lighting devices capable of emulating white light or sunlight. These attempts sometimes result in using LEDs that may have many advantages over incandescent light sources including lower energy consumption, less heat, longer lifetime, improved physical robustness, smaller size, and faster switching. However, it may be very expensive and difficult to emulate white light or sun light with LEDs. More specifically, LED lighting may produce "pixalized" light, where individual LED lights produce non-uniform light such that one can tell there are individual light sources instead of a continuous source. To address this issue in linear LED lighting fixtures, a lens or optic needs to be moved toward the LEDs and the space between each LED ("pitch") needs to be minimized. Without doing so, unsightly pixilation can occur, which is unacceptable for direct-view installations.

Pixel pitch increases exponentially with the introduction of colored LEDs as the space between each color becomes the visible pitch that requires mitigation. The simplest way to create a diffused, warm-dimming type, architectural, dynamic lighting fixture is to utilize the fewest number of LED's per increment. The ultimate goal is to represent the visible light spectrum with specific and repeatable spectral values or useful warm-white color temperatures on the Kelvin scale; while following the visual aesthetics of the Planckian locus on the lower/warmer end. There has also been difficulty emulating incandescent lighting colors and dimming performance.

In physics and color science, the Planckian locus or black body curve is the path or locus that the color of an incandescent black body would take in a particular chromaticity space as the blackbody temperature changes. It goes from deep red at low temperatures through orange, yellowish white, white, and finally bluish white at very high temperatures. Black body sources (i.e., generally any filament bulb or sunlight, but not fluorescent lamps) emit a smooth distribution of wavelengths across the visible spectrum, which means that human eyes and visual system can reliably distinguish colors of non-luminous objects. Subconsciously, humans adapt to differing bias in the illuminant color, and manage to perceive consistent colors in the artifacts handled every day (food, clothes, etc.), despite wide variations in their absolute color. Artificial sources of light, in particular discharge lamps (sodium, mercury, xenon), LEDs, and fluorescent lamps can have extremely spikey spectral distributions, which means their color rendering properties may typically be very poor, even if the overall perceived illuminant color is close to a blackbody color. Color Rendering Index, CRI (sometimes written Ra: Red Average) is often quoted to indicate how accurately that light will portray colors relative to a blackbody source (e.g. the sun) at the same nominal color temperature. By definition, all blackbody sources have a CRI of 100. Fluorescent lamps typically have CRIs in the range 55-85, with 80-85 being classed by the manufacturers as 'good' or 'very good' color-rendering.

As mentioned above, pixelation is a common drawback of LED lighting where the visible light emitting diodes can catch the viewer's eye due to perceived brightness. LED lighting is usually comprised of an array of light sources that are each a point source of light. Pixelation can be a distraction from the design aesthetic and has been characterized by most as undesirable. Pixelation of LED lighting is usually mitigated by the use of a diffuser lens. A diffuser is usually comprised of a translucent material like acrylic that utilizes white pigment to cover the point sources and blend the perceived pixels (i.e., dots). Diffusers generally will absorb approximately 25% of the light energy in the process. Consequently, by definition, diffusion will widen the given light beam perpendicular to the beam to hide the pixelation and, thus, can be counterproductive when attempting to create a narrow beam.

Further in architectural lighting, there is a need to shape the light beam emitted from a standard 120 degree LED diode to become narrower, to provide farther reach and more "punch." In many cases light shape can mean the difference between displaying a stripe versus an even light wash on a flat surface. In linear LED lighting, optics and lenses can be integrated into an extruded aluminum housing that doubles as a heat sink for the circuit board electronics. The effect of making a light beam narrower is known as "collimation." Some existing linear optics are designed to narrow light beams, but have issues with unsightly yellow colored stripes that appear as artifacts at the most narrow beam angles. This effect is known as "color over angle." Pigment is often added to the diffuser material to mitigate the yellow stripes or to remove unsightly pixilation. These diffuser modifications will increase the diffusing effect and further widen the beam, which is often not desirable.

Thus, it is a long felt need in the lighting field to provide a method of interconnecting a severed tape light segment to an adjacent tape light segment or power source with the ease of the mechanical connector and the benefits of hand soldering. It is also a need to sometimes ensure the light emitted from the LEDS is of a particular or desired character and quality. This disclosure describes an improved connector used to join two severed segments of LED light tape, methods to control the character of emitted lights and ways to diffuse emitted light. One of ordinary skill in the art will appreciate that the aspects can be employed alone, in combination, or in sub-combination(s) to yield the desired lighting effects.

SUMMARY OF THE INVENTION

It is one aspect of some embodiments of the present invention to provide LED tape comprising a plurality of LED lighting affixed to a substrate elements that can be selectively cut and interconnected to a power source or another section of LED tape without using a mechanical connection means, e.g., a connector or soldering. In one embodiment of the present invention, a plurality of surface-mounted contact terminals are employed on the LED tape that serve as locations for receiving a wire connector that connects adjacent light strip segments.

It is, thus, one aspect of embodiment of the present invention to provide LED tape comprised of a plurality of LED light elements and having a plurality of pairs of positive and negative contact terminals positioned at or near a lateral edge of the light tape. The contact terminals include conductors and circuit board elements that electrically communicate with a wire that extends from wires or circuits of one LED light element to the next. Initially, the adjacent contact terminals are interconnected with a pin or wire. The pins or wires, and in some embodiments substrate, spanning the gap between consecutive contact terminals are severed to reduce the length of the LED tape.

It is another aspect of some embodiments of the present invention to interconnect adjacent LED light tape segments with common electrical wire. In some instances, a 20 gauge wire is cut to a desired length and interconnected to the terminal connectors of adjacent LED tape segments. One of ordinary skill in the art will appreciate that smaller wires, such as 12 to 14 gauge wire, may be employed without departing from the scope of the invention if lower voltage or amperage can be used. Each contact terminal may employ a circuit board that allows for light feature control such as brightness, light quality, etc.

It is still yet another aspect of the present invention to provide a tape light system that provides significant cost savings to the installer. More specifically, installing LED tape that employs plurality of contact terminals that are interconnected by lengths of pre-cut wire, time associated with soldering or otherwise interconnecting adjacent segments of LED tape is omitted. In operation, the installer simply inserts positive and negative wires of a connection wire pair into corresponding contact terminal receptacles that employ, for example, push-in connectors (e.g., dagger connectors) that rely on an interference fit to secure the wires of the connecting wire pair. In other embodiments, the connecting wire pair is held within the contact terminals by set screws.

It is another aspect of some embodiments of the present invention to provide LED light elements of LED tape that emit a narrow beam of light. That is some embodiments of the present invention minimize diffusion of the LED light elements to maintain a narrow beam, while also mitigating pixelation by using a secondary optic working in convert with existing LED light element optics. The secondary optic includes an inner rough side and an outer smooth side. The inner rough side is comprised of many microscopic lines that extend perpendicular to the line of LED light elements of the LED tape. The lines effectively blend the pixels into a visible line of light, while further collimating the optic and a narrow beam effect. The end result is a fixture that can produce a very narrow beam without yellow stripes or pixelation and minimal energy loss from the LED lenses.

It is yet another aspect of same embodiment of the present invention to provide systems, software, and methods for variable, efficient, dynamic LED lighting control. In one example, a two-channel linear LED tape light system is selectively controlled to emulate dimming of an incandescent light fixture. In another embodiment, a tape light system may include red, green, blue, and white linear LED light clusters that may be dynamically controlled such that the cluster produces specification grade, quality, white light from about 2150K candle light color to 5500K daylight white color. Furthermore, the white LED of the cluster may be controlled such that the white LED CRI is approximately 95 to ensure optimal results when mixed with red and green.

It is one aspect of some embodiments of the present invention to provide a lighting system, comprising: an elongate substrate; a plurality of spaced lighting elements positioned on the substrate; at least one cut line located between a first lighting element and a second light element of the plurality of spaced lighting elements; a plurality of contact terminals mounted on the substrate, the contact terminals having a first positive portion positioned on one side of a cut line and a second positive portion positioned on an opposite side of the cut line, and having a first negative portion positioned on one side of a cut line and a second negative portion positioned on an opposite side of the cut line; a first connector associated with each of the contact terminals interconnecting the first positive portion and the second positive portion; and a second connector associated with each of the contact terminals interconnecting the first negative portion and the second negative portion.

The Summary of the Invention is neither intended nor should it be construed as being representative of the full extent and scope of the present invention. That is, these and other aspects and advantages will be apparent from the disclosure of the invention(s) described herein. Further, the above-described embodiments, aspects, objectives, and configurations are neither complete nor exhaustive. As will be appreciated, other embodiments of the invention are possible using, alone or in combination, one or more of the features set forth above or described below. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
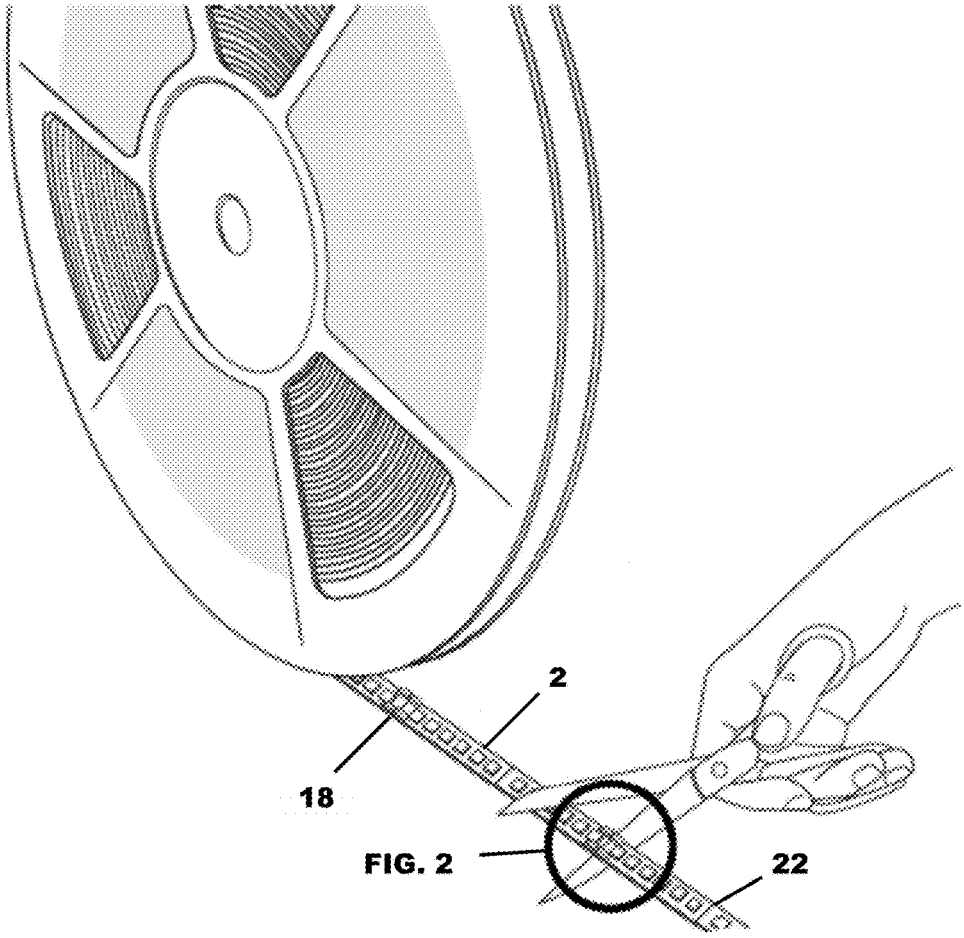
FIG. 1 is a perspective view showing a spool containing LED tape of one embodiment of the present invention.

The following component list and associated numbering found in the drawings is provided to assist in the understanding of the present invention.

COMPONENT

2 LED tape
6 Light element
10 Contact terminal
12 Substrate
14 Pin
16 Adhesive
18 Cutline
22 Secondary cutline
30 LED tape segment
32 Severed end
34 Wire connector
50 Collimating optic
54 LED light source
58 Light pattern
62 Narrow light pattern
66 Lenticular sheet
74 Ridged surface
78 Smooth surface
100 Lighting control environment
110 Lighting fixture
Component
111 Lighting fixture
112 Lighting fixture
120 Controller
121 Controller
122 Controller
130 Communication network
140 User device
200 Dimming curves
210 Intensity axis
220 Time axis
230 Cool white light
240 Ultra warm or warmer white light
300 Controller environment
310 Driver
311 Driver
312 Driver
313 Light fixture
314 Light fixture

315 Light fixture
320 Controller
325 Input device
330 Router
332 Communication link
334 Communication link
336 Communication link
340 User device
350 Direct tuner module (DTM)
400 Computing environment
405 Communications network
410 Computing system
Component
412 Software
414 Storage system
416 Processing system
418 Communication interface
420 User interface
430 Application interface
440 Software module
450 System
452 Software
454 Storage system
456 Processing system
458 Communication interface
458 Medication interface
460 Software module It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 2:
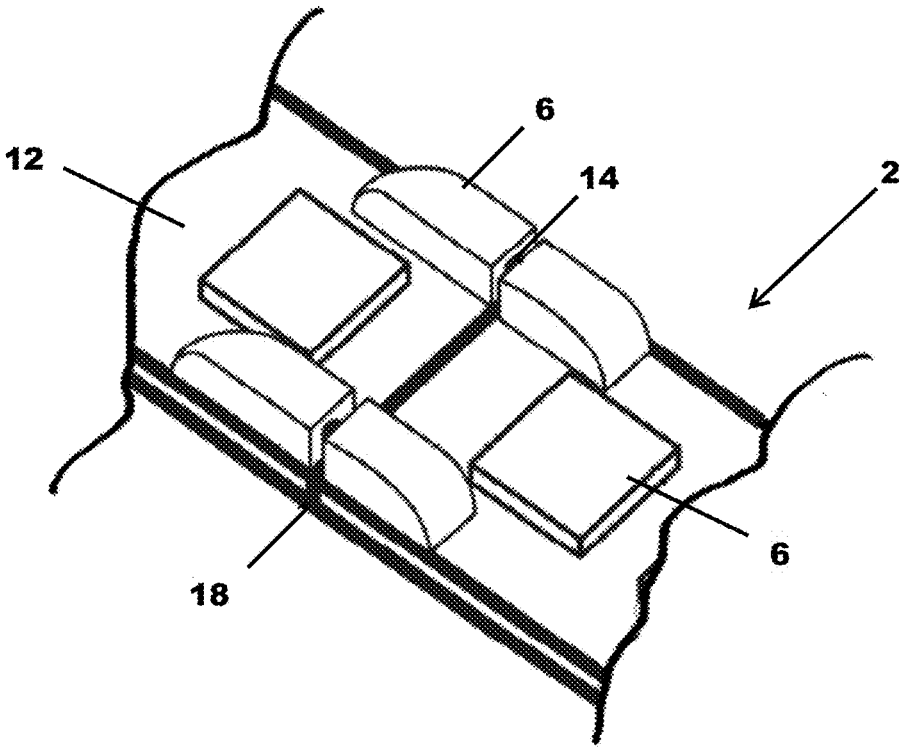
FIG. 2 is a detailed view of FIG. 1.
Figure 3:
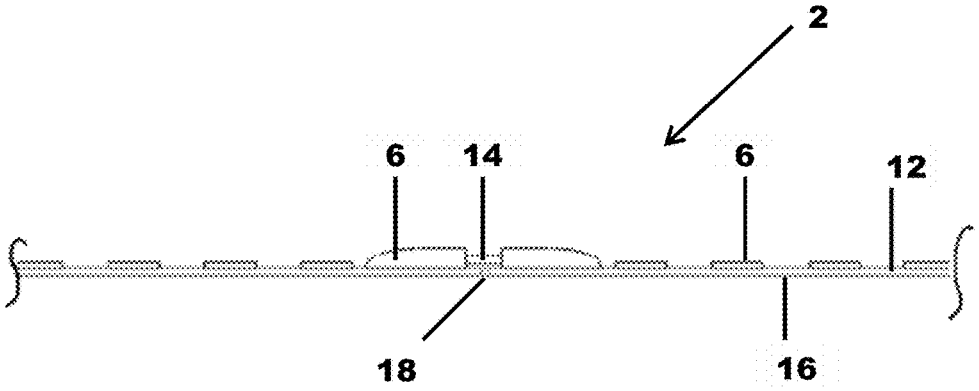
FIG. 3 is a front elevation view of the LED tape of one embodiment of the present invention.

FIGS. 1 and 2 show LED tape 2 of one embodiment of the present invention that employs a plurality of LED light elements 6 and contact terminals 10 interconnected to a substrate 12 that may employ an adhesive 16 on a side opposite the light elements 6. In one embodiment of the present invention, sixteen contact terminal pairs are provided per foot of LED tape 2. One of ordinary skill in the art will appreciate that more or fewer connector terminal pairs 10 may be employed without departing from the scope of the invention. Each connector terminal 10 pair includes circuiting that allows for current and signal communication through interconnected tape segments for power and functional instructions (e.g., light color, intensity, and quality).

Adjacent contact terminals 10 are electrically and mechanically interconnected by wires or pins 16 a positive pin 14P and a negative pin 14N connecting each contact terminal 10 pair positioned on the LED tape 2. Preferably, the LED tape 2 is severed at discrete locations, for example, every 6 inches, by cutting the wires or pins 14 that connect adjacent contact terminals 10. The pins 14 are held within the contact terminals 10 by mechanical push-in connecting members, but other interconnection mechanisms and methods can be used without departing from the scope of the invention. In some embodiments, the connecting pins 14 are the only mechanism by which a plurality of LED tape 2 segments are held together. In other embodiments, the substrate 12 extends below the pins 14.

The LED tape 2 may also include a plurality of primary cut lines 18 positioned between contact terminals 10. If the pins 14 are used to hold individual tape segments together, the cutline 18 will be indicated by a break in the substrate 12. If the substrate 12 is used to also interconnect adjacent LED tape segments, a cutline 18 can be drawn or otherwise indicated on the substrate 12, wherein the user would cut through the pins 14 and substrate 12 located under the pins. Another method would be to cut the substrate 12 and remove the pins 14 from the terminal connector 10. The LED tape of some embodiments of the present invention may also include a plurality of secondary cut lines 22, for example, positioned between each primary cutline. The secondary cut lines allow the LED tape 12 to be cut in such a way to provide more robust length options. If a secondary cutline is used, the severed end would have to be connected to a power source or an adjacent LED tape segment as in the prior art with a mechanical connector or by soldering.

Figure 4:
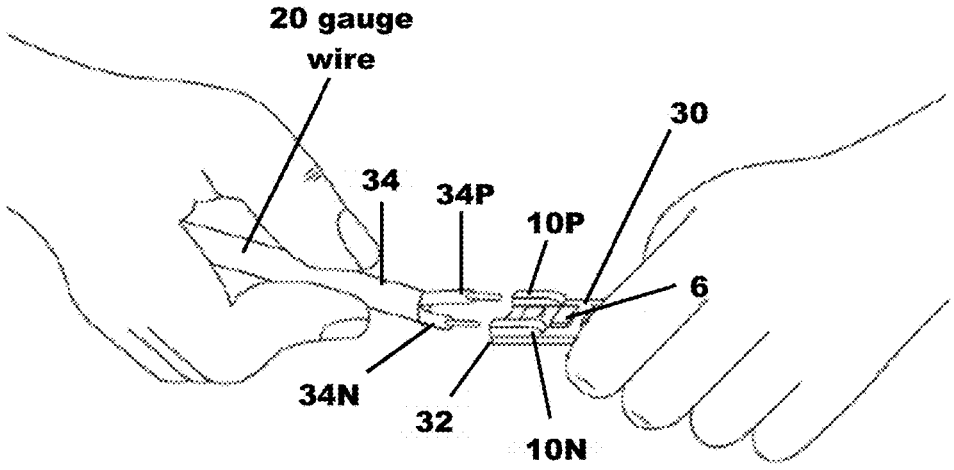
FIG. 4 is a perspective view showing interconnection of a wire connector to the severed end of a LED tape segment.
Figure 5:
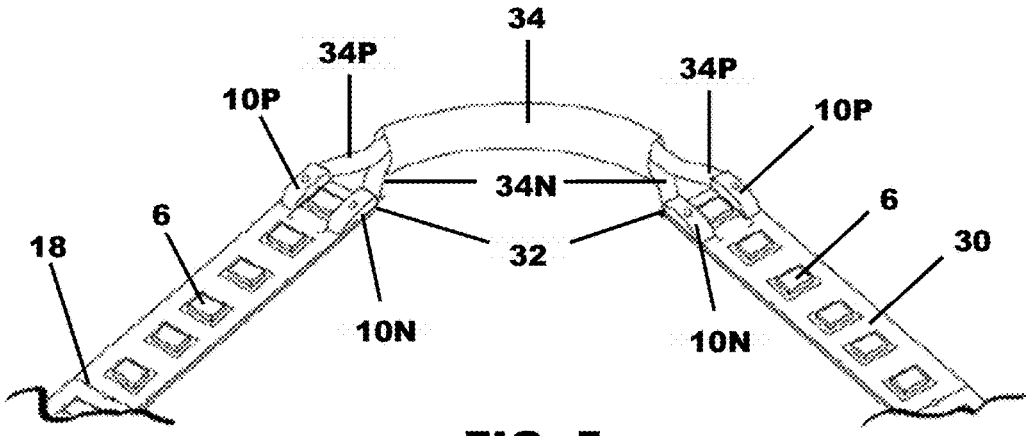
FIG. 5 is a perspective view showing the connection of two LED tape segments.

FIGS. 4 and 5 illustrate how severed LED tape segments 30 are interconnected. Initially, the user identifies the desired length of LED tape and cuts the same from the spool, for example to define a severed end 32. If applicable, wires or pins previously used connect adjacent contact terminals 10. The user then cuts a length of wire from wire spool to create a wire connector 34. Some of the insulator is removed from the ends of the wire connector to expose positive 34P and negative wires 34N configured to interconnect to positive 10P and negative 10N contact terminals of the LED tape segments 30 to be interconnected. One of ordinary skill in the art will appreciate that employing a plurality of surface-mounted poke-in type contact terminals, which may employ a circuit board connector, is more efficient than employing prior methods of interconnection with respect to time and cost savings.

Figure 6:
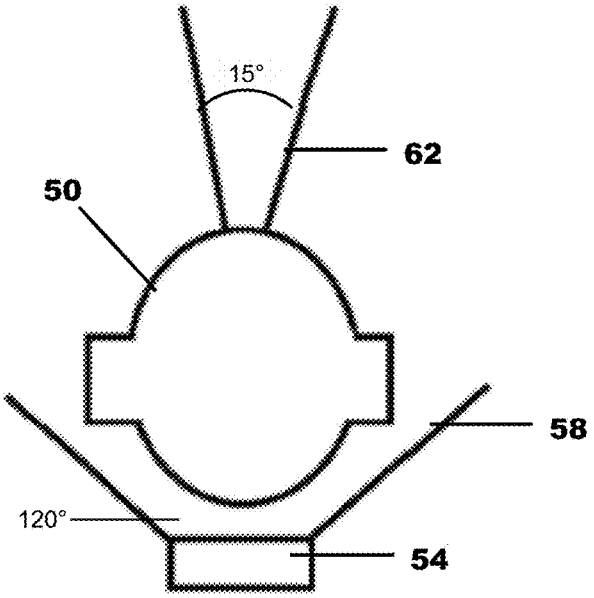
FIG. 6 is a schematic of a collimating optic of the prior art.

FIG. 6 illustrates a collimating optic 50 of the prior art that is used in conjunction with an LED source 54. The LED source 54 emits a light pattern of a first character, a feature of which is the light beam's width. Light exiting the collimating optic 50 has a narrowed light pattern. In the example shown, the LED light source 54 emits light at about 120 degrees which the collimating optic 50 reduces to about 15 degrees. This may be undesirable as narrow light beams often result in a pixilation effect.

Figure 7:
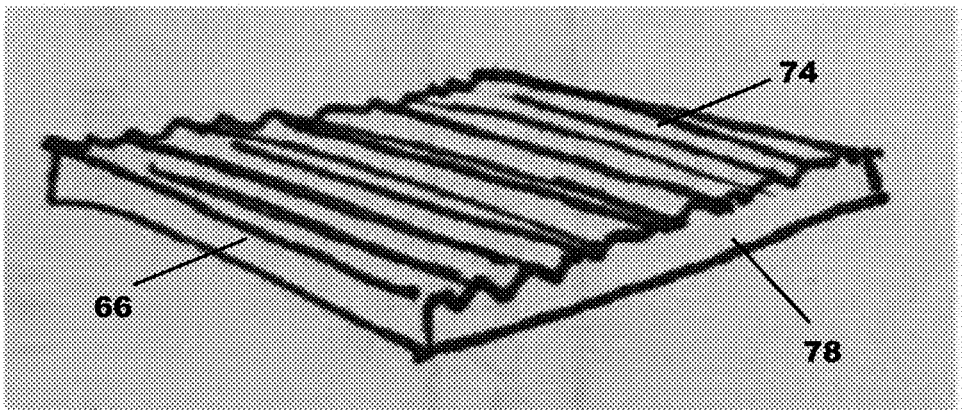
FIG. 7 is a perspective view of a secondary optic used in one embodiment of the present invention.
Figure 8:
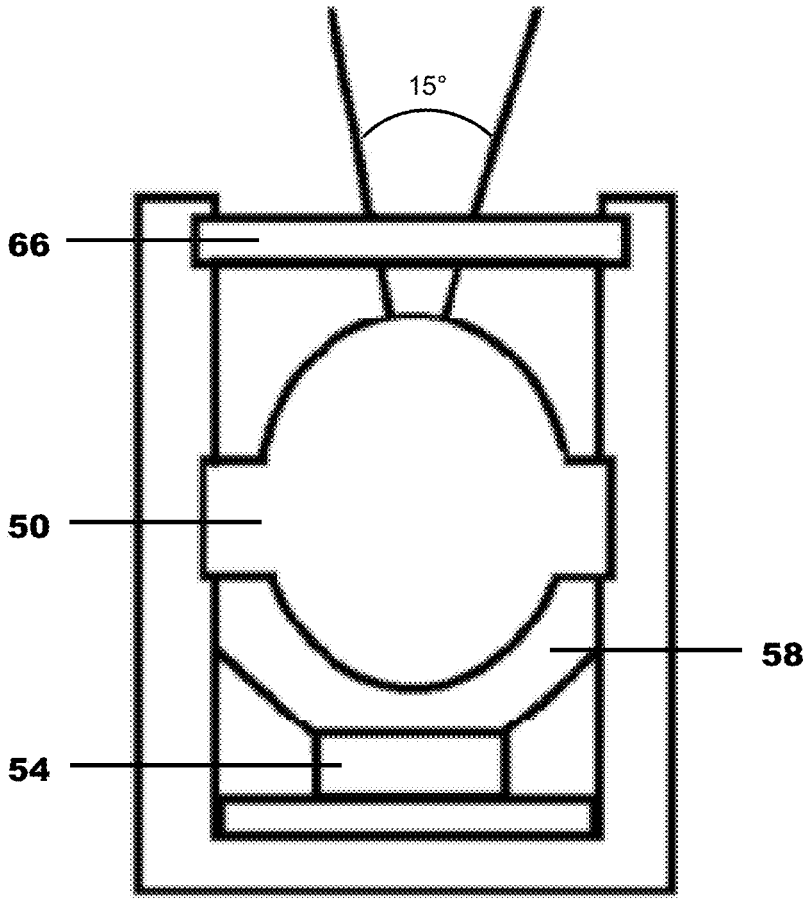
FIG. 8 is a schematic of a collimating optic employed by one embodiment of the present invention.

FIGS. 7 and 8 show a way to add a second optic to address the issue of pixelation. More specifically, the collimating optic 50 is placed between the LED light source 54 and a lenticular sheet 70. The lenticular sheet 70 has a first, ridged surface 74 and the second, smooth surface. In operation, the smooth surface faces the collimating optic 50 such that light passing through the lenticular sheet 70 substantially maintains its character (i.e., narrowness) to provide the desired effect. The ridged surface 74 the lenticular sheet 66 modifies the narrow light beam to remove the pixelation effect. One of ordinary skill in the art will appreciate that a secondary optic as contemplated herein can be incorporated into the LED tape described above. Alternatively, the LED tape can be used in conjunction with collimating optics 50 and lenticular sheets 66 that are incorporated into a fixture used in conjunction with a line of LED light sources.

FIGS. 9-13 show systems, software, and methods for lighting control. In one embodiment, a two-channel LED lighting system, which may be the light elements used in the LED tape described above, is controlled to emulate the visual perception of dimming an incandescent fixture. In an example, a lighting fixture may include red, green, blue, and white emitting LED modules. The lighting fixture may be controlled such that it produces generally white light from about 2150 Kelvin Candle Light color to 5500K Daylight White color with four LEDs. Furthermore, the white LED may be controlled such that the white LED CRI is approximately 95 to ensure optimal results when mixed with red, green and blue. In another embodiment, a two-channel LED lighting system is controlled to emulate dimming of an incandescent fixture. In the other embodiment, a four-channel LED lighting system is controlled to similarly emulate dimming of an incandescent fixture, however also can produce colored light.

A two channel or two LED dynamic lighting module system of one embodiment of the present invention allows for smooth "warm-dimming" effect created by two warm white LEDs in one fixture or light cluster employed on a LED tap substrate. A first LED module may be capable of outputting a generally warm white light. The other LED module may be capable of outputting a generally ultra-warm or warmer white light. Here a two-channel system is controlled to never let the total output (sum) percentage between the two LED modules exceed 100%.

Figure 10:
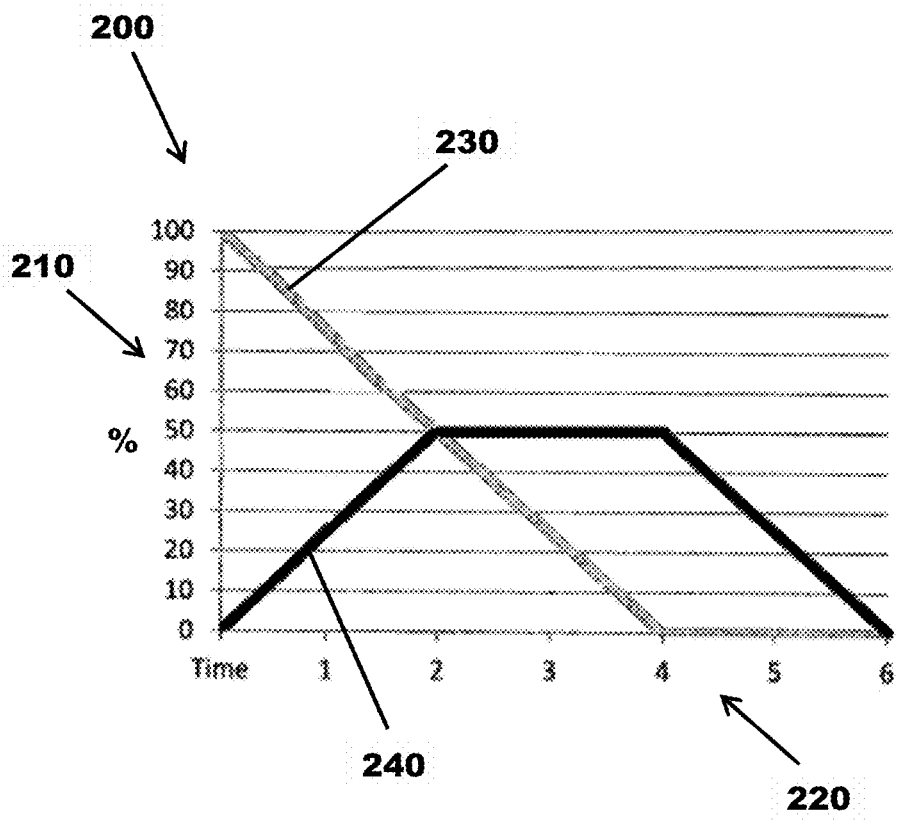
FIG. 10 illustrates a "warm" dimming curve for a two-channel LED system.

Thus, the contemplated system allows for the warm dimming effect to occur with only two LEDs, which may be important for smaller-profile, linear applications that required tight pitch (i.e., the spacing between LEDs) for uniform diffusion, thereby reducing pixilation. As shown in FIG. 10, the cool LED at max brightness begins to descend in intensity while the warm LED simultaneously increases intensity from zero. Rather than crossing over in the middle and trading, control includes that the warm LED stops at 50% and returns to zero. This is one aspect of the invention and the characteristics of this "dim curve" or distribution of relative dim levels that may be required for optimal results when: 1) the LEDs are arranged in the form of a linear array, such as found in LED tape; or 2) small profile extruded fixture housings paired with diffuser and beam-shaping optics are employed.

Embodiments of the present invention may provide a large range of "warmer" colors using only 4 LED modules. Most current systems may use 5-6 LED modules to create the same effects. The red, green and blue are usually supplemented by a warm and a cool white.

The lighting fixtures or the LED tape may be controlled at least in part by a DMX-type controller paired with multiple power supplies (drivers). At the heart of one system herein is a DTM, or "Dynamic Tuner Module." The DTM is a network device that can communicate with lighting controls and fixtures via a network router. DTM may also link to an iOS or Android-type device over WI-FI or Bluetooth®, putting the power to configure, control and customize intensity, color and color temperature of white lighting usable at a user device, such as a smartphone.

A four-channel dynamic color/RGBW source or module fixture is employed by one embodiment that includes an LED X-Series Driver made and sold by Aion LED®, paired with a linear color tuning strip light, working together to produce millions of vibrant colors including full-spectrum white and soft pastels. The X-Series driver may integrate a four-channel in-line dimmer with a 24V DC constant voltage type electronic power supply and an LCD display for ease of programming. The driver may use a logarithmic pulse width modulated (PWM) dimming, which allows for smooth, flicker-free performance down to the lowest color, intensity, and power levels. The system is unique in that it can produce white light from a very warm 2150K Candle Light color to 5500K Daylight White color with only four colored LEDs.

The correlated color temperature (CCT) is a specification of the color appearance of the light emitted by a module or lighting source, relating its color to the color of light from a reference source when heated to a particular temperature, measured in degrees Kelvin (K). The CCT rating for a lamp is a general "warmth" or "coolness" measure of its appearance. However, opposite to the temperature scale, lamps with a CCT rating below 3200 K are usually considered "warm" sources, while those with a CCT above 4000 K are usually considered "cool" in appearance.

The white LED light source or module (W in RGBW) that is used was developed on a similar wavelength as the red in an ultra-warm hybrid between white and amber. Technically, it is white, but looks more like an amber color. The Color Rendering Index (CRI) of the white light that created with four colored LEDs is considered "High CRI" at 85. High CRI lighting is required for the most prestigious and high-end lighting applications. The CRI of the systems disclosed herein may be increased to 95 to ensure optimal results when mixed with red, green and blue.

To have repeatable results, the LEDs must have the best available batch consistency. A 2 Step MacAdam Ellipse consistency may be used, ensuring that there is a minimal or no visual variance of the LEDs from batch to batch, and even from the individual LED module within a batch. This technology allows the system to publish and adhere to third-party laboratory test results of its fixture performance including with mixed colors.

The disclosed systems and methods are capable of producing accurate color temps of "full-visual spectrum" white. Visual consistency from batch to batch is improved with industry-leading 2 step MacAdam distribution protocol employed during the manufacturing process. Individual LEDs are custom made for both fixtures to meet these criteria to ensure repeatable results that are congruent with 3rd party IES LM 79 luminaire testing set forth by the Illumination Engineering Society (IES) as a standard required for measuring performance, Quality Assurance (QA), and to qualify lighting fixtures for government subsidized rebate programs including energy efficiency programs including California's "Title 24", DesignLights Consortium (DLC), and Energy Star.

Other manufacturers of down lights have been trying to achieve full-spectrum color tuning, but may use 5-7 colored LED sources or modules. They employ additive color mixing, supplementing the red (R), green (G) and blue (B) with a warm and a cool LED. Embodiments of the present system approaches color mixing from a subtractive perspective by saturating the red and proprietary ultra-warm white LED and then reducing the relative green and blue to make beautiful and accurate shades of white. This makes it possible to mix full spectrum light within a smaller package so that it can fit inside a low-profile, compact, linear LED fixture housings or on a substrate to form LED tape that are popularly used in cove lighting and other linear lighting applications.

Further, the mixed white light of this system produces is "High CRT" which refers to the "Color Rendering Index." High CRT lighting is preferred and sometimes required for many commercial and high-end residential installations. Each segment of the linear strip light creates a 6 LED circuit for each color within a two-inch span of the linear circuit board. Each of the four colors features a chip that is used to mitigate variance in current, voltage and temperature primarily in order to protect the investment, but also to ensure flicker-free dimming to the lowest levels.

Systems, methods, and software disclosed includes mixing four colored LEDs using a four-channel dynamic color/RGBW fixture to create full-spectrum white light, ranging from candle light color to daylight white. This functionality lends to circadian rhythm lighting applications that have become popular in the 21st century. Scientists and educators agree that red and blue content found within light affects the mind and body in ways that were never before understood. Mood, productivity, rest and other aspects of life have been linked to lighting and how it affects people. California's UC Davis CLTC program continues to lead the research into this phenomenon and the applicant is working as an active partner to help bring 'circadian rhythm' lighting systems to the hospitality and healthcare markets. The controller location may be known by the IP or MAC address and the circadian rhythm may be programmed to occur at corresponding time of the day at the location of the controller.

The Dynamic Tuner system can be controlled in at least four ways: iOS App, Android app, Native Keypad, and 3rd Party keypad from automation system by others. Further, the DTM can be configured with an optional In/Out (I/O) card that allows connectivity via serial and contact closure. This solves the problem of having two separate keypads for your lighting fixture versus other types in the home. This feature allows the system to be used with larger controls companies as a complimentary solution rather than a competitor in the lighting controls market.

Figure 9:
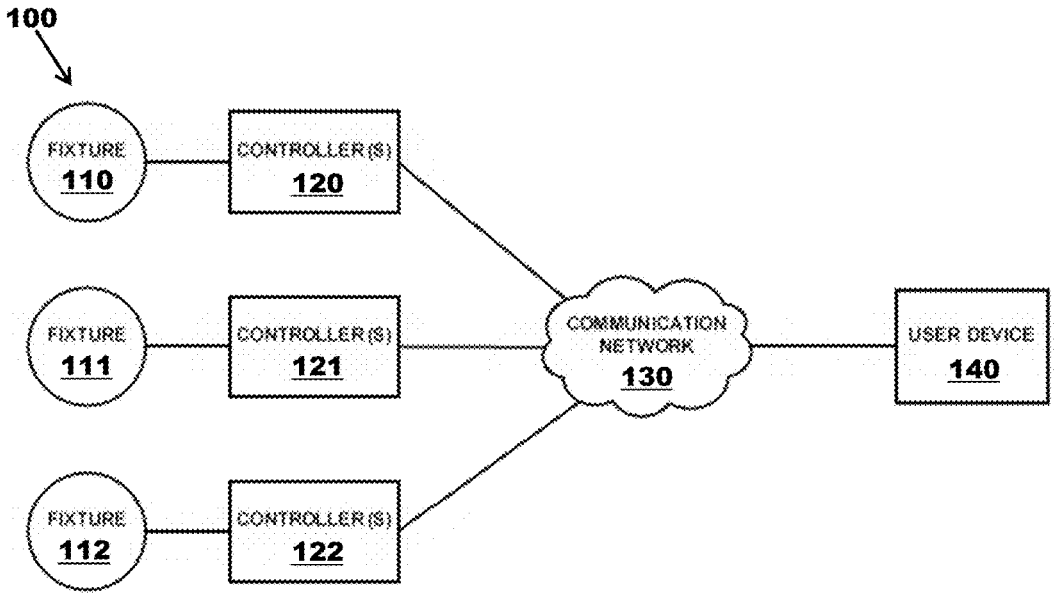
FIG. 9 illustrates a system according to one embodiment of the present invention.

FIG. 9 illustrates a lighting control environment 100 according to one example. System 100 includes fixtures 110-112 (which may be interconnected to a substrate to form LED tape), controller(s) 120-122, communication network 130, and user device 140. In FIG. 9, controllers 120-122 provide control information to the fixtures 110-112. Control information may be sent to the controllers 120-122 and/or fixtures 110-112 by a user device 140 via communication network 130.

In an example, fixtures 110-112 can include a red, green, blue, and white LED source or module. One or a plurality of fixtures may be controlled via one or more controllers 120-122. The white LED (W in RGBW) that is used was developed on a similar wavelength as the red in an ultra-warm hybrid between white and amber. Technically, it is white, but looks more like an amber color to the human eye. The communication between fixtures 110-112 and controllers 120-122 may be wired or wireless.

In this example, controller 120-122 may include a dynamic tuner module, DMX controller, driver, dimmer, and other devices and software. Controllers 120-122 may control fixtures 110-112 as described throughout this disclosure. Controller may also be included on a lighting driver, and accessed via the dynamic tuner module to a user device.

Communication network 130 can include the Internet, cellular, Wi-Fi, blue-tooth, satellite, radio frequency (RF), or any other form of wires or wireless communication network between fixtures 110-112, controllers 120-122, and user device 140, and can include cloud-type programs and devices. User device(s) 140 can smart phones, tablets, or any other device capable of sending and receiving information to the fixtures 110-112, controllers 120-122. The information may include information associated with lighting control, configuration information, and information about the fixtures 110-112, controllers 120-122, and/or the user device(s) 140, or other information.

FIG. 2 is an example 2 LED source dim graph 200 and curve, according to an example. Graph 200 includes an intensity axis 210, and a time axis 220 in seconds, showing the control of two LED modules.

The illustrated dimming pattern that allows for smooth warm-dimming effect created by two warm white LED sources or modules in one fixture. The first LED module may be capable of outputting a generally cool white light 230. The other LED module may be capable of outputting a generally ultra-warm or warmer white light 240.

This "dim curve" protocol and method was created by the applicant in order to specifically satisfy the need to efficiently emulate the perceived visual lighting performance and aesthetics of older incandescent light bulbs. When a modern LED dims, it does not change color and does not dim to a warm glow like we were used to seeing with prior technology.

Other manufacturers may attempt to cross-fade intensity between warm and cool, but the effect is not natural, or does not look natural. The solution includes never letting the total output percentage between the two LEDs exceed 100%. The cooler LED begins at 100% and dims to 50% while the warmer LED simultaneously ramps up to 50% and meets the cool LED at 50% and then dims out. The cool LED must always go down and at 50% the warm LED has peaked and then dims to off. The opposite is true when dimming up to 100% from off.

The following Table 1 includes the intensity percentage and time values for the graph in FIG. 10.

| Time (sec) | Cool | Warm |
|---|---|---|
| 0 | 100 | 0 |
| 1 | 75 | 25 |
| 2 | 50 | 50 |
| 3 | 25 | 50 |
| 4 | 0 | 50 |
| 5 | 0 | 25 |
| 6 | 0 | 0 |

The applicant has also created a similar system for mixing colored LEDs to blend at various dim levels to create additional colors including millions of colors, pastels, warm white, neutral white, cool white from 2150K to 5500K. A unique aspect of the LED technology is its ability to save its complex proprietary dimming curves and programming to a device as well as to a power supply. Various additional functionality may be stored at a driver or the DTM to permit LED sources to have the additional functionality as disclosed herein. The system may be triggered by a keypad or scheduler from a third party button press for repeatable results.

Current LED dimming may vary and will not mimic an incandescent light. The curve in FIG. 10 allows for the warm dimming effect to occur with only two LED sources or modules, which is imperative for linear applications that required tight pitch (spacing between LEDs) for uniform diffusion. In the curve in FIG. 10, the cool LED source at max brightness or intensity begins to descend while the warm LED source intensity is increased from zero. Rather than crossing over in the middle and trading, the curve of FIG. 10 dictates that the intensity of the warm LED stops at 50% and returns to zero percent.

Another breakthrough is that a four-channel dynamic color/RGBW fixture system can create very nice white light ranging from candle light white to daylight white, in addition to millions of colors and pastels. This enhanced functionality allows for the reproduction of daylight indoors without windows as well as simulation of the sun thought the day for circadian rhythm applications.

Further, the new four-channel dynamic color/RGBW fixture system can create a similar warm-dimming effect to the 2 Channel Dynamic Cool/Warm 'Dim to Glow' product, but instead of using a warm white and cool white LED, it uses a red, green, blue and a warm white LED that contains proprietary specifications and electrical characteristics to create a high rendering (90+CRI) white that is amplified by the mixed white light created by mixing Red, Green and Blue together. The result is a full-spectrum tuning system that can also do warm dimming and can be triggered easily by most 3rd party keypads and controls schedulers.

Figure 11:
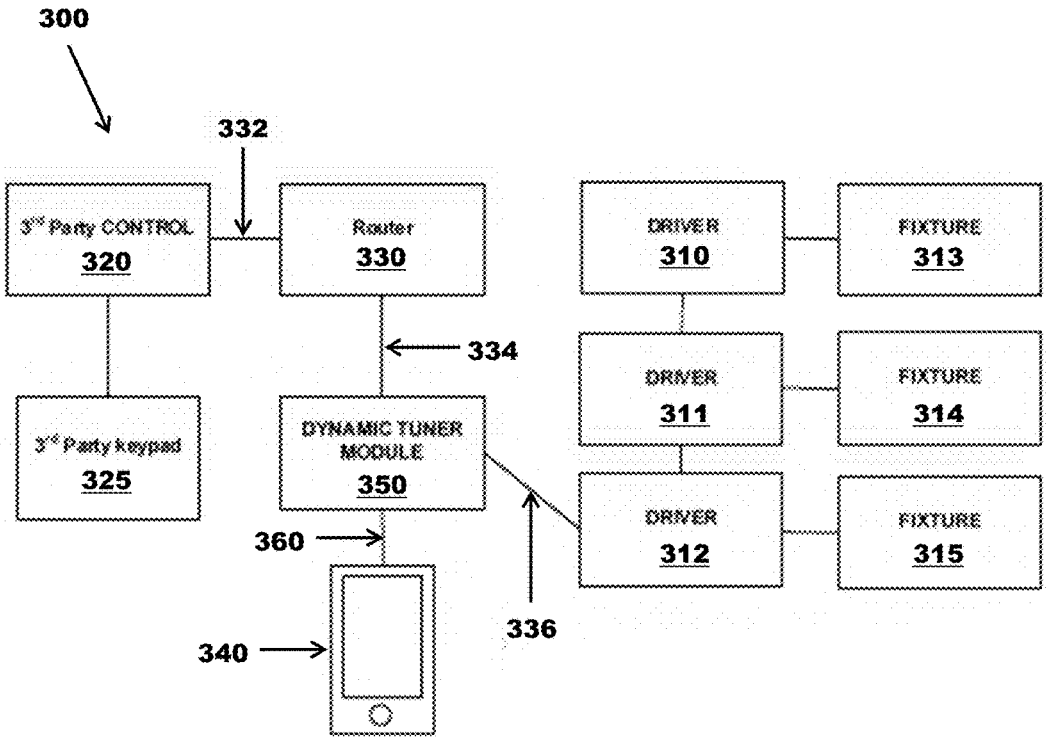
FIG. 11 illustrates a system controller environment according to one embodiment of the present invention.

FIG. 11 is a lighting system controller environment 300, according to one example. The controller environment 300 includes drivers 310-312, fixtures 313-315 controller(s) 320, router 330, and user device 340. System 300 may also include an input device 325, which is configured to communicate with control 320, either wired or wirelessly, to provide information to send native or segmented lighting control information to drivers 310-312 to control lighting fixtures 313-315 attached thereto.

Control 320 may send information to router 330 via communication link 332, which may be wired or wireless. The information sent by control 320 may be user datagram protocol (UDP), or other format. Router 330 may send information to or through DTM 350 via communication link 334, which may be wired or wireless. DTM 350 may send information to drivers 310-312 via communication link 336, which may be wired or wireless. Drivers 310-312 may be configured to communicate between themselves or directly to the DTM 350.

DTM 350 may communicate with user device 340 to receive non-native lighting control information via script commands or other protocol, system, or method. An application on user device 340 may be configured to intercept or otherwise receive the native lighting control information being sent from control 320 to drivers 310-312 and modify, or augment it via the DTM 350. DTM 350 may open a tel-net session, or other communication systems or methods, with the control 320 for communication.

Augmented lighting control information may them be sent from the DTM 350 to the drivers 310-312 to provide control of fixtures 313-315. This may add functionality not included in the control 320, and may give a user an easier interface to use to control drivers 310-312 and fixtures 313-315 coupled thereto.

In an example, a user may input lighting control information at input device 325, which is sent to control 320. Control 320 creates coded information to control the lighting fixtures in a first or native format or language, via drivers 310-312. That information in a first language is sent via communication links and router 330 to DTM 350.

The application on the user device 340 communicates with the DTM 350, and takes the information in the first language and receives non-native information from the user device 340. The DTM 350 may then combine the native and non-native information to create augmented lighting control information 336, which is sent to the drivers 310-312 to control fixtures 313-315. The segmented lighting control information may provide additional functionality for controlling the fixtures 313-315, than by the native controls.

Furthermore, additional functionality may be implemented and the resulting information and added information may be sent to the fixtures via the drivers 310-312. This may provide addition functionality, such as warm dim and better color tuning and control that is available via control 320. If no additional functionality is desired, the native information may be passed directly on to the drivers 310-312.

In another embodiment, the application on the user device 340 communicates with the DTM 350, and takes the native information and adds/changes/augments it to create different control information (augmented) to change the behavior of the fixture(s).

The DTM 350 may be added to an existing third party system to enhance the functionality of the lighting control, as well as give a user an application on a user device 340 to more easily control the lighting fixtures. The DTM 350 may add functionality without have to hardwire more control pads or install an entire new control system.

Native lighting control information may be in DMX format, and may include on, off, and brightness level. The functionality of the app on the user device 340, and the DTM 350 may include additional functionality, including RGBW control to mix the output of the fixtures to produce warmer or better white light. Furthermore, the fixtures 313-315 may include only two colors, and the user device 340 and the DTM 350 may provide a warm dim output, which emulates dimming of an incandescent fixture.

One unique feature of the dynamic tuner module 350 is how it interacts with an iOS App on the user device 410, 340, 140. The DTM 350 arrives without loaded software and the iOS app allows the installer to configure the DTM 350 by loading the appropriate software based on fixture type and technology (2 channel Dim to Glow or 4 Channel RGBW+). Once loaded, the installer further configures the system by selecting which of the App's 4+ features to populate onto the 6 available keypad and virtual buttons (plus 2 for UP/DOWN), among other functionality: Color, Cycle, Dim to Glow, and Sundial.

The 'Color' feature allows users to select colors from a virtual color dial as well as shades of white from a linear gradient on the GUI. Essentially, users can select colors, edit and save them to memory for use with the 'Cycle' feature or for special themes, occasions, moods, etc. 'Cycle' provides the ability to rotate through selected and customized colors at user-defined rates and fade times.

'Dim to Glow' feature allows the user to populate a button after designating a maximum white level (CCT) and then to populate a button and when dimmed with the DOWN ARROW, the light color temperature incrementally warms to a glow as the light dims down to 0.1%.

'Sundial' is a scheduler with Astrological Time Clock features and global positioning. Sundial can emulate daylight by use of an atomic clock via the app on the user device 340. The IP address of the user device 340 provides the latitude and longitude of a given location to accurately determine sunrise and sunset times that vary throughout the year based on the position of the earth in relation to the sun. Sundial allows users to place Color, Cycle and Dim to Glow events in time on a 24 hour basis, 7 days a week. Sundial™ can schedule lights to change color, intensity and temperature on a 24-hour basis, 7-days a week.

The LED Dynamic Tuner iOS App (with Sundial) will allows installers the power to easily and efficiently commission the system (configure buttons, colors and other parameters), to perform multi-channel color tuning operations such as "warm dim", without needing to understand nor implement complex DMX programming. Installers and now even end users can set up complex operations including appropriation of button functionality, setting up multiple dim curves that work in concert to achieve various colors, color temperatures of whites at dim levels between 0.1 and 100%, color cycles, and daylight emulation.

It is a known problem that DMX lighting requires an expert to be hired in addition to the electrician in order to program the system. Many times the programmer is sent by the equipment manufacturer to remote locations world-wide at the expense of the end user. The Dynamic Tuner App eliminates all of that, saving all parties involved time and money. Additional functionality may be sent to the DTM 350 from the user device 340 and stored at the DTM 350. Using the app on the user device 340, an unskilled user may relatively easily select and assign various functionality to the button presses from the existing system. No additional programming or programmer is needed.

Some popular high-end control systems such as Lutron Electronics' 'Radio RA' type dimming system do not include a DMX interface, making it impossible to interface with multi-channel lighting at all. The disclosed system provides a solution by employing a unique method of communicating with 3rd party keypad (integration) via the Dynamic Tuner iOS App on the user device 340.

The hardware part: "Dynamic Tuner Module" 350 ships un-loaded with software, then the installer (or user) uploads the appropriate functionality based on the application's requirements. The installer can set up a 1:1 correlation between the 3rd party keypad's buttons and the Dynamic Tuner iOS App's virtual buttons. By doing so, all that needs to be done on the third party side is to send button press on/off data via contact closure relay, RS-232 (Serial cable) or TCP/IP (Ethernet); that the Dynamic Tuner iOS app translates into complex operations via its proprietary native code and downloads to the Dynamic Tuner Module during setup. Other manufacturers may use their own keypads and dimmers with their devices. Aion LED prefers its users to select their favorite or existing major brand dimmer that is compatible with the DTM.

In another example, the driver 310-312 may be a warm-dimming LED driver, which may provide a simpler solution to dimming LED lights to a warm glow without the need for a more complex DMX system or tuner.

This driver may simplify and automate the process of creating the warm-dimming effect by storing multi-channel dim curves on a microprocessor and memory that can store the dim curves and can be activated by a standard wall box dimmer. The microprocessor may be a part of the DTM or the driver. This driver simplifies wiring, installation and saves cost and eliminates the DMX and DMX drivers required with the DTM solution.

This may also allow device 340 to communicate directly with the drivers 310-312, and provide the functionality to receive the binary communication from the third party control, and change and or augment the communication to change the control information and thereby change the functionality of the driver 310-312.

The Dynamic Tuner Module 350 and iOS app ("the app") on the user device 340 may first discover available Dynamic Tuner Modules 350 by broadcasting a Multicast Ping to 239.255.204.2 on the local network, to which each Dynamic Tuner Module 350 responds with its IP address and other basic information. In the event that the Dynamic Tuner Module 350 is not responding or unreachable, the server-related information can also be entered in manually.

Once the correct information has been supplied and the app is able to connect to the Dynamic Tuner Module 350 by issuing a test command, the app begins by initializing basic commands to establish expected security needs (password) and configuration needs. The app then writes a collection of universal commands that can be later used by individual presets that manage stored variables in memory. The goal of initializing these universal commands is to simplify and shorten the complexity and therefore save time of individual button presets that the user creates.

From the app, simple commands are issued over the network as short strings understandable by Dynamic Tuner Module 350 in the form of native or other script commands to activate saved button presets that depend on the universal commands.

The app allows for network triggers to be created on the Dynamic Tuner Module 350 so that it can listen for network traffic on specific ports and/or IP addresses with specific strings. Depending on the received string, it can perform simple commands, such as activating a specified preset. Network triggers are particularly useful so that 3rd party devices can issue commands that Dynamic Tuner Module 350 responds to in the same way that it responds to the app's simple commands.

On setup completion, the app's home screen is displayed on the user device 350 with buttons that mirror the layout of button wall panels 325 used in similar systems. Each button can be edited to write a custom preset functionality to the Dynamic Tuner Module 350 from the app that can be operated later without the use of the app. Once the preset is defined and saved to the Dynamic Tuner Module 350, only simple commands are needed from the app, wall panel, or network trigger to activate the complex logic that manages button presets.

All of the independent and integrated functionality is created from within the app so that it can configure Dynamic Tuner Module 350 to listen to 3rd party commands, manage dimming, dim level recall, active sundial states, active color, and cycle speeds behind the various preset modes.

The system includes software interface as well as the LED systems and associated dimming levels and methods utilized to create full-spectrum color-tuning lighting systems that can reproduce accurate, high quality lighting.

Figure 12:
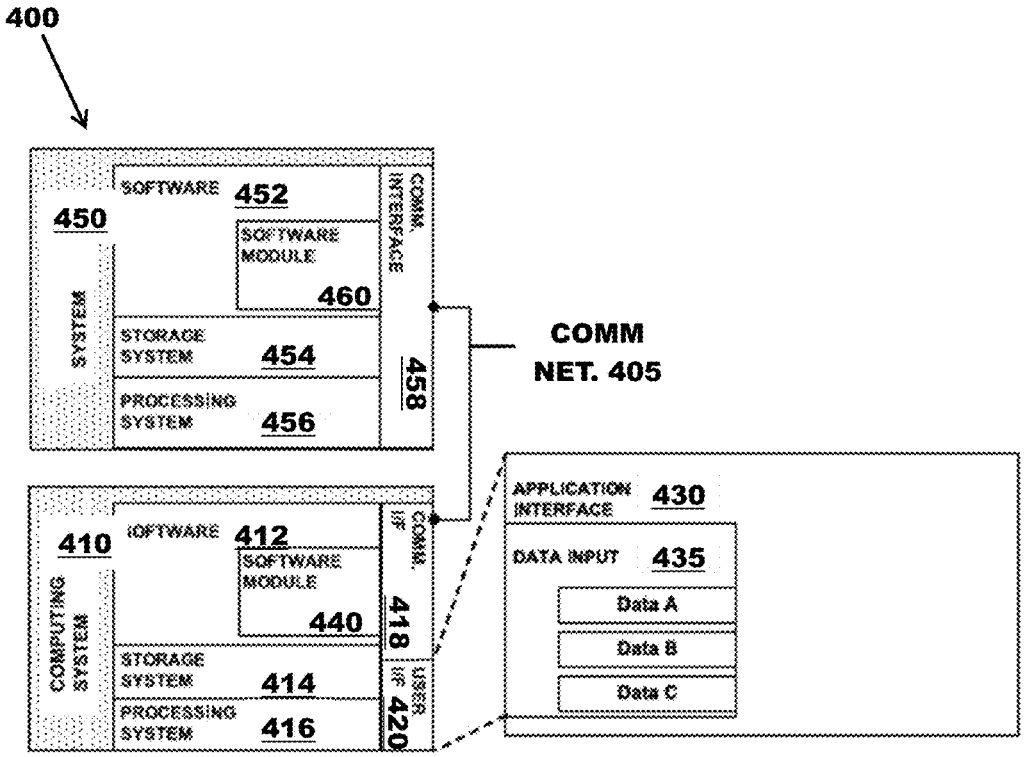
FIG. 12 illustrates a system controller environment, according to one embodiment of the present invention.

FIG. 12 illustrates a monitoring computing environment 400 according to one example. In an example, computing environment 400 includes computing system 410 and system 450. Computing system 410, in the present example, corresponds to user device 140 (FIG. 9), and system 450 corresponds generally to controllers 120-122 and 320 (FIGS. 10 and 11).

Computing system 410 can include any smart phone, tablet computer, laptop computer, computing device, or other device capable of reading, and/or recording data about systems, devices, locations, and/or equipment, etc. System 450 can include any controller, module, software, or other device capable of controlling fixtures 110-112.

In FIG. 12, computing system 410 includes processing system 416, storage system 414, software 412, communication interface 418, and user interface 420. Processing system 416 loads and executes software 412 from storage system 414, including software module 440. When executed by computing system 410, software module 440 directs processing system 416 to accomplish all or portions of the methods and other controls described in this disclosure. It should be understood that one or more modules could provide the same operation.

Additionally, computing system 410 includes communication interface 418 that can be further configured to transmit the information to system 450 using communication network 405. Communication network 405 could include the Internet, cellular network, satellite network, RF communication, blue-tooth type communication or any other form of wired or wireless communication network capable of facilitating communication between systems 410, 450.

Referring still to FIG. 12, processing system 416 can comprise a microprocessor and other circuitry that retrieves and executes software 412 from storage system 414. Processing system 416 can be implemented within a single processing device but can also be distributed across multiple processing devices or sub-systems that cooperate in executing program instructions. Examples of processing system 416 include general purpose central processing units, application specific processors, and logic devices, as well as any other type of processing device, combinations of processing devices, or variations thereof.

Storage system 414 can comprise any storage media readable by processing system 416, and capable of storing software 412. Storage system 414 can include volatile and nonvolatile, removable and non-removable media implemented in any method or technology for storage of information, such as computer readable instructions, data structures, program modules, or other data. Storage system 414 can be implemented as a single storage device but may also be implemented across multiple storage devices or sub-systems. Storage system 414 can comprise additional elements, such as a controller, capable of communicating with processing system 416.

Examples of storage media include random access memory, read only memory, magnetic disks, optical disks, flash memory, virtual memory, and non-virtual memory, magnetic cassettes, magnetic tape, magnetic disk storage or other magnetic storage devices, or any other medium which can be used to store the desired information and that may be accessed by an instruction execution system, as well as any combination or variation thereof, or any other type of storage media. In some implementations, the storage media can be a non-transitory storage media. In some implementations, at least a portion of the storage media may be transitory. It should be understood that in no case is the storage media a propagated signal.

User interface 420 can include a mouse, keypad, a keyboard, a camera, a Barcode scanner, a QR scanner, a voice input device, a touch input device for receiving a gesture from a user, a motion input device for detecting non-touch gestures and other motions by a user, and other comparable input devices and associated processing elements capable of receiving user input from a user. These input devices can be used for indicating lighting control and other information. Output devices such as a graphical display, speakers, printer, haptic devices, and other types of output devices may also be included in user interface 420. The aforementioned user input and output devices are well known in the art and need not be discussed at length here.

Application interface 430 can include data input section. In one example, data input 435 can be used to collect/input information regarding lighting control from a user.

System 450 may include processing system 456, storage system 454, software 452, and communication interface 458. Processing system 456 loads and executes software 452 from storage system 454, including software module 460. When executed by computing system 450, software module 460 directs processing system 410 to store and manage the data from computing system 410 and other similar computing systems and keypads and other input devices. Although system 450 includes one software module in the present example, it should be understood that one or more modules could provide the same operation.

Additionally, system 450 includes communication interface 458 that can be configured to receive the data from computing system 410 using communication network 405. Furthermore, communication interface 418, 458 is capable of sending and receiving information to and from fixtures capable of transmitting and receiving information wirelessly, such as via a Bluetooth-type communication.

Referring still to FIG. 12, processing system 456 can comprise a microprocessor and other circuitry that retrieves and executes software 452 from storage system 454. Processing system 456 can be implemented within a single processing device but can also be distributed across multiple processing devices or sub-systems that cooperate in executing program instructions. Examples of processing system 456 include general purpose central processing units, application specific processors, and logic devices, as well as any other type of processing device, combinations of processing devices, or variations thereof.

Storage system 454 can comprise any storage media readable by processing system 456 and capable of storing software 452 and data from computing system 410. Data from computing system 410 may be stored in a many forms. Storage system 454 can include volatile and nonvolatile, removable and non-removable media implemented in any method or technology for storage of information, such as computer readable instructions, data structures, program modules, or other data. Storage system 454 can be implemented as a single storage device but may also be implemented across multiple storage devices or sub-systems. Storage system 454 can comprise additional elements, such as a controller, capable of communicating with processing system 456.

Examples of storage media include random access memory, read only memory, magnetic disks, optical disks, flash memory, virtual memory, and non-virtual memory, magnetic cassettes, magnetic tape, magnetic disk storage or other magnetic storage devices, or any other medium which can be used to store the desired information and that may be accessed by an instruction execution system, as well as any combination or variation thereof, or any other type of storage media. In some implementations, the storage media can be a non-transitory storage media. In some implementations, at least a portion of the storage media may be transitory. It should be understood that in no case is the storage media a propagated signal.

In some examples, system 450 could include a user interface, such as a keypad or other input device or system. The user interface can include a mouse, keypad, a keyboard, a voice input device, a touch input device for receiving a gesture from a user, a motion input device for detecting non-touch gestures and other motions by a user, and other comparable input devices and associated processing elements capable of receiving user input from a user.

It should be understood that although computing system 450 is shown as one system, the system can comprise one or more systems to store and manage received data.

Figure 13:
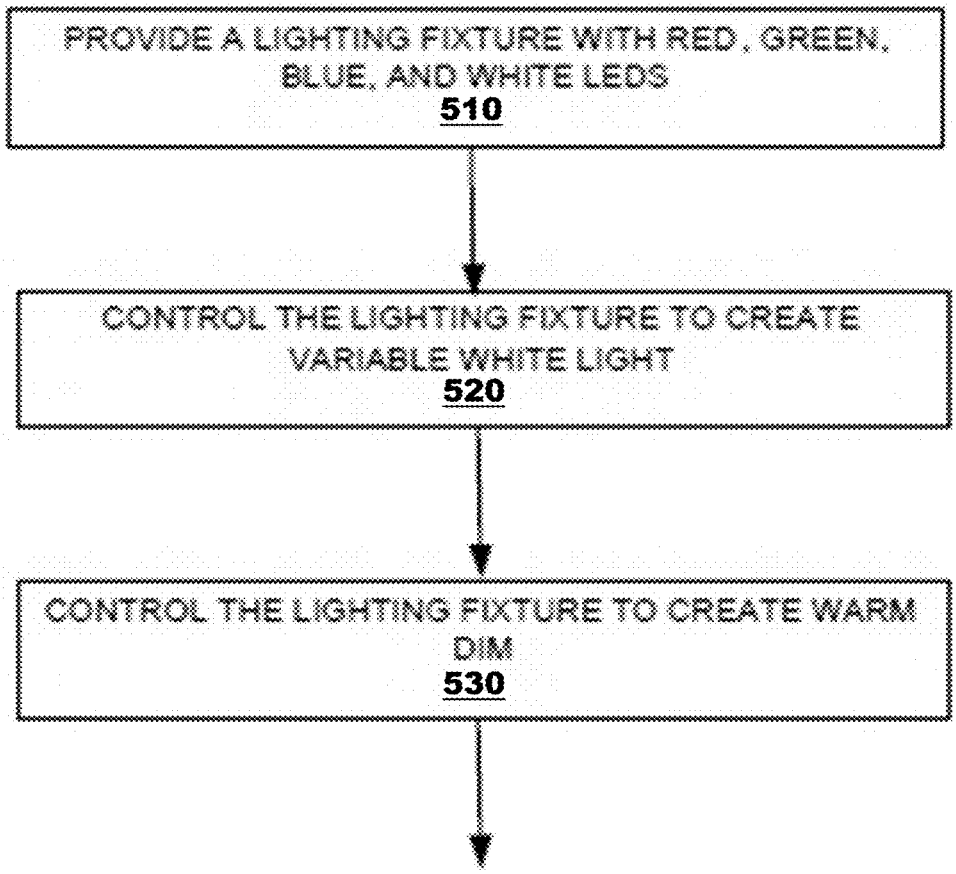
FIG. 13 illustrates a method according to one embodiment of the present invention.

FIG. 13 illustrates a method for controlling lighting systems, devices, and/or software, etc. The method begins with providing one or more lighting fixtures with red, blue, green, and white producing LEDs 510.

A controller may be used to control the fixtures to create or provide variable white light 520. Control information may be provided by a user device 140. This user device may include a smart phone, tablet computer, monitoring device attached to a vehicle, or any other device configured to send information to controllers or fixtures or other equipment, etc.

The variable white light may be produced using four-channel dynamic color/RGBW fixture system, by saturating the red and white LED and then reducing the relative green and blue to make beautiful and accurate shades of white.

Method may also include controlling a lighting fixture to create a warm dim output 250 (FIG. 10). In one embodiment the desired output is a generally a warm white light. In other embodiments the desired output is a warm dim effect, as described in FIG. 13.

Although the example method described as controlling a four-channel dynamic color/RGBW fixture, it may be used to control other types of lighting fixtures. Additionally, it should be understood that the order of events in method could be rearranged and/or accomplished concurrently.

While various embodiments of the present invention have been described in detail, it is apparent that modifications and alterations of those embodiments will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. An lighting system, comprising:

an elongate substrate;

a plurality of spaced lighting elements positioned on the substrate;

at least one cut line located between a first lighting element and a second light element of the plurality of spaced lighting elements;

a plurality of contact terminals mounted on the substrate, the contact terminals having a first positive portion positioned on one side of a cut line and a second positive portion positioned on an opposite side of the cut line, and having a first negative portion positioned on one side of a cut line and a second negative portion positioned on an opposite side of the cut line;

a first connector associated with each of the contact terminals interconnecting the first positive portion and the second positive portion; and a second connector associated with each of the contact terminals interconnecting the first negative portion and the second negative portion.

2. The lighting system of claim 1, wherein the first connector is a first metallic pin and the second connector is a second metallic pin.

3. The lighting system of claim 1, wherein the first connector and the second wire are flexible wires.

4. The lighting system of claim 1, wherein the first positive portion, the second positive portion, the first negative portion, and the second negative portion of the at least one contact terminal employ a push-in connectors or set screws configured to selectively secure the first connector and the second connector.

5. The lighting system of claim 1, wherein the substrate is a strip of predetermined length having a first edge and a second edge that define a width, wherein the length is greater than the width, and wherein the at least one cut lines are comprised of a perforation that extends from the first edge and the second edge.

6. The lighting system of claim 1, wherein the substrate is a strip of predetermined length having a first edge and a second edge that define a width, wherein the length is greater than the width, wherein the at least one cut lines sever the substrate from the first edge to the second edge such that the substrate is composed of a series of interconnected members, and wherein the first connectors and the second connectors interconnect the members.

7. The lighting system of claim 1, wherein the substrate is a strip of predetermined thickness and length having a first edge and a second edge that define a width, wherein the length is greater than the width, and wherein the at least one cut lines are comprised of an area of decreased thickness spanning from the first edge to the second edge.

8. The lighting system of claim 1, wherein the plurality of spaced lighting elements comprise at least one lighting element that emits light of a first pattern, and further comprising:

a collimating optic positioned within the first light pattern, the collimating optic changing the first pattern to a second light pattern that is different from the first light pattern; and a lenticular sheet positioned within the second light pattern.

9. The lighting system of claim 1, wherein the plurality of spaced lighting elements emit light of a first character, and further comprising a fixture placed over at least a portion of the plurality of spaced lighting elements, the fixture comprising:

a collimating optic positioned over each of the spaced lighting elements of the portion thereof, the collimating optic changing the first character to a second character that is different from the first character; and a lenticular sheet positioned over the collimating optics and within the light of a second character.

10. The lighting system of claim 9, wherein the lenticular sheet has a first surface that is smooth and a second surface is textured, wherein the textured surface is facing the collimating optics.

11. The lighting system of claim 1, wherein the plurality of lighting elements are each comprised of a pair of LEDs comprised of a generally warm white color light emitting diode light source and a generally ultra-warm white light emitting diode light source, and further comprising:

a controller configured to communicate with the plurality of lighting elements and to selectively alter the nature of the light being emitted therefrom, wherein the controller is adapted to selectively:

vary the generally warm white color light emitting diode light source from about 100 percent output to about 50 percent output, while varying the generally ultra-warm white light emitting diode light source from about zero percent output to about 50 percent output, vary the generally warm white color light emitting diode light source from 50 percent output to zero percent output, while maintaining the generally ultra-warm white light emitting diode light source generally at 50 percent output, and vary the generally ultra-warm white light emitting diode light source from 50 percent output to zero percent output, while maintaining the generally warm white color light emitting diode light source generally at zero percent output; and wherein the generally warm white color light emitting diode light source outputs light at a first color temperature, and the generally ultra-warm white light emitting diode light source outputs light at a second color temperature that is different from the first color temperature.

12. The lighting system of claim 11, wherein the plurality of lighting elements are each comprised of a pair wherein the first color temperature is about 3000 Kelvin, and the second color temperature is about 2150 Kelvin.

13. The lighting system of claim 1, wherein the plurality of lighting elements are each comprised of a cluster of LEDs comprised of a generally red, green, blue, and ultra-warm, high CRI, white light emitting diode modules, and further comprising:

a controller configured to communicate with the plurality of lighting elements and to selectively alter the nature of the light being emitted therefrom, wherein the controller is adapted to selectively control the at least one lighting elements by at least in part using a dynamic tuner module coupled to a driver, the driver coupled to the lighting fixture at least in part via a four-line dimmer;

wherein the controlling comprises using logarithmic pulse width modulated dimming, and produces the variable white light from about 2150 Kelvin candle light to generally about 5500 Kelvin daylight white with only the generally red, green, blue, and white light emitting diode modules; and wherein the color rendering index of the white light emitting diode module can be controlled to achieve approximately 95.

14. The lighting system of claim 13, wherein lighting fixture is further capable of being controlled at least in part via a user device capable of sending information to a controller, wherein the information comprises lighting control information.

15. The lighting system of claim 13, wherein a communication path between a user device and the dynamic tuner module comprises a blue-tooth, cellular, satellite, Wi-Fi, wired, wireless, near field, or radio frequency-type communication path.

16. The lighting system of claim 13, wherein the method further comprises using a cloud-based application and/or storage.

17. The lighting system of claim 13, wherein the controlling comprises saturating the red and the white light emitting diode, and then reducing the relative green and blue to produce a generally warm white light in the range of 2000-5600 Kelvin.

* * * * *